United States Patent [19]
Erndt
[11] 4,106,945
[45] Aug. 15, 1978

[54] INVESTMENT MATERIAL

[75] Inventor: Edmund E. Erndt, Timberlake, Ohio

[73] Assignee: Precision Metalsmiths, Inc., Cleveland, Ohio

[21] Appl. No.: 799,523

[22] Filed: May 23, 1977

Related U.S. Application Data

[63] Continuation of Ser. No. 689,153, May 24, 1976, abandoned.

[51] Int. Cl.² ..... B28B 7/34
[52] U.S. Cl. ..... 106/38.3; 106/38.9; 106/68; 106/109
[58] Field of Search ..... 106/38.3, 38.27, 38.9, 106/68, 109, 67

[56] References Cited

U.S. PATENT DOCUMENTS

| | | | |
|---|---|---|---|
| 2,102,444 | 12/1937 | Van Allen | 106/109 |
| 3,132,955 | 5/1964 | Nameishi | 106/67 |

*Primary Examiner*—Lorenzo B. Hayes
*Attorney, Agent, or Firm*—Watts, Hoffmann, Fisher & Heinke

[57] ABSTRACT

In the manufacture of non-ferrous investment casting molds, a new investment material composed of a gypsum binder and a refractory which is at least in part pyrophyllite.

8 Claims, No Drawings

INVESTMENT MATERIAL

CROSS-REFERENCE TO RELATED APPLICATION

This application is a continuation of application Ser. No. 689,153 filed May 24, 1976 now abandoned, and entitled Investment Material.

BACKGROUND OF THE INVENTION

The present invention relates generally to the investment casting art, and more specifically to a new investment material for use in making refractory molds.

Non-ferrous investment casting molds are prepared by placing a pattern assembly or tree in a flask and then filling the flask with a refractory investment slurry which is allowed to harden in the flask to form the mold. The pattern assembly or tree is comprised of a plurality of patterns having the configurations of the desired metal castings, the patterns being made of wax, plastic or other expendable material. After the investment slurry has set hard, the patterns are melted out of the mold by heating it in an oven, furnace or autoclave. The mold is then fired to an elevated temperature, as for example 1350° F., to remove water and burn off any residual pattern material in the casting cavities. In many instances, the mold is first cooled to a lower temperature in order to obtain optimum casting conditions before filling it with molten metal. For example, it is the practice to cool the molds to a temperature in the range of from room temperature to about 400°-500° F. when casting aluminum.

Conventional non-ferrous investment formulations are comprised of a binder and a refractory made up of a blend of fine and coarse particles. The refractory usually is wholly or at least in part a silica, such as quartz, cristobalite or tridymite. Calcined fire-clay also is often used as a part of the refractory. The binder is typically a fine gypsum powder (calcium sulfate hemihydrate).

The binder and refractory, together with minor chemical additives to control setting or hardening characteristics, are dry blended to produce the investment. The dry investment is then prepared for use by mixing it with sufficient water to form a slurry which can be poured into the flask around the set-up. Vacuuming of the slurry and vibration of the flask are frequently employed steps to eliminate air bubbles and facilitate filling of the flask.

A serious problem encountered with conventional investment molds is the frequent occurrence of cracking during the heating and/or cooling cycles and during the metal casting operation. If a vacuum is applied to the molds during pouring of the metal, the molds are subjected to additional stresses which can contribute to cracking.

Mold cracking results in metal flash on the castings which must be removed by expensive finishing operations. Mold cracking also permits particles or flakes of investment material to break loose and fall into the mold cavities. This can produce inclusions in the castings and cause them to be rejected. In instances where cracking is especially severe, the molten metal can leak through the mold wall so that the entire mold must be scrapped.

SUMMARY OF THE INVENTION

One possible explanation of the occurance of cracking encountered with conventional non-ferrous investments is that it is due to the expansion and contraction characteristics of the silica refractory. It has been speculated that when a conventional investment mold is heated for burnout of the pattern material, the silica irregularly expands while the gypsum binder decomposes due to dehydration. The expansion of the silica is reversible so that it contracts when the mold is cooled preparatory to casting of the molten metal. Because of the decomposition of the gypsum binder and the contraction of the silica, the mold shrinks away from the surrounding metal flask upon cooling so that the flask no longer provides adequate support for the relatively weak mold material.

It has now been discovered that substitution of pyrophyllite for at least part of the silicas or other refractories commonly used in non-ferrous investment results in a marked reduction of mold cracking. In many instances, the use of a pyrophyllite has been found to completely eliminate casting flash and lost molds and to cause a substantial reduction of inclusions in the castings.

The invention provides a new investment material composition consisting essentially of a gypsum binder and a refractory which includes pyrophyllite in an amount of from 15 to 100% by weight based on the total weight of the refractory. In particularly suitable compositions, the pyrophyllite is in the range of from 55 to 65% by weight of the total weight of the refractory. A specific composition contemplated by the invention consists essentially of from 20 to 40% by weight of a gypsum binder and from 60 to 80% by weight of a refractory which is from 55 to 65% by weight pyrophyllite. If desired, minor amounts of chemical additives for controlling setting characteristics may be included in the investment compositions in accordance with conventional practice.

Pyrophyllite is a hydrous aluminum silicate having the formula $Al_2Si_4O_{10}(OH)_2$. Commercial grades containing moderate amounts of other minerals as impurities are satisfactory for purposes of this invention.

It is believed that an investment made with pyrophyllite permanently expands when heated to the temperatures involved in firing investment molds. Because of this permanent expansion, the cooled mold is larger than the original. As a result, the flask acts to compress the mold material so as to provide the strength that is needed to resist cracking.

An important feature of the invention is that the improved resistance to cracking is obtained without a significant increase in the strength of the fired mold. As a result, there is no added difficulty in removing the mold material from the finished metal castings.

Other advantages and a fuller understanding of the invention will be had from the following detailed description which sets forth one illustrative example.

DESCRIPTION OF THE PREFERRED EMBODIMENT

An investment was prepared having the following composition in parts by weight: 30.0% alpha gypsum, 30.0% silica, and 40.0% pyrophyllite. In order to control the setting time of the investment, small additions were made of terra alba and sodium citrate in respective amounts of about 0.7% by weight based on 100 parts of weight of the gypsum, silica and pyrophyllite.

The chemical analysis of the pyrophyllite was as follows:

| | Percent by weight |
|---|---|
| Alumina ($Al_2O_3$) | 19.77 |
| Silica ($SiO_2$) | 75.0 |
| Ferric Oxide ($Fe_2O_3$) | 0.7 |
| Sodium and Potassium Oxides | 0.3 |
| CaO | 0.1 |
| MgO | 0.1 |
| L.O.I. | 3.9 |

The pyrophyllite was a mixture of graded particles having the following typical screen analysis:

| U.S. Series Screen No. | Cumulative % Retained |
|---|---|
| 16 | 0 |
| 20 | 1.3 |
| 30 | 14.5 |
| 40 | 26.8 |
| 50 | 41.0 |
| 70 | 52.5 |
| 100 | 62.4 |
| 140 | 68.1 |
| 200 | 74.9 |
| 325 | 81.9 |
| Pan | 100.0 |

The investment was mixed with water in a ratio of 34 parts by weight water to 100 parts by weight investment to yield a slurry of normal consistency. The slurry was mixed and poured under vacuum into four flasks around previously prepared pattern set-ups using equipment of the type disclosed in U.S. Pat. No. 3,719,214, issued Mar. 6, 1973 to Edmund E. Erndt. Each pattern set-up invested in the flasks consisted of 10 wax patterns of a commercial part made of aluminum, the patterns being mounted on a cardboard drum.

After the investment had hardened, the cardboard drums were removed and the molds were dewaxed in a low pressure steam autoclave and then transferred to a hot furnace at about 1350° F for approximately 10 hours. Each mold was then cooled at about 400° F and placed over a resin bonded sand core to form a ¼ inch sprue cavity.

Molten aluminum alloy at 1300° F was poured into the assembled molds under vacuum, and immediately after pouring, the pressure on the metal in the pouring opening was raised to atmospheric pressure while a vacuum was continued to be applied around the outside of the molds during the solidification period.

There were no cracks visible in any of the four molds either before or after casting. The investment material was soft and easily removed from the castings. The castings, including the sprues and gates, were completely free of flash. Previous production of the same parts using conventional investments had been characterized by excessive metal flash due to mold cracking which had to be removed in an extra operation.

Many variations and modifications of the invention will be apparent to those skilled in the art in light of the foregoing detailed disclosure. Therefore, it is to be understood that, within the scope of the appended claims, the invention can be practiced otherwise than as specifically described.

What is claimed is:

1. An investment material for use in making fired refractory molds consisting essentially of a gypsum binder and a refractory which is at least 15% by weight pyrophyllite.

2. An investment material according to claim 1 in which the refractory is from 55 to 65% by weight pyrophyllite.

3. An investment material according to claim 1 in which the gypsum binder is present in an amount of from 20 to 40% by weight based on the total weight of the investment material and the refractory is present in an amount of from 60 to 80% by weight based on the total weight of the investment material.

4. An investment material according to claim 3 in which the refractory is from 55 to 65% by weight pyrophyllite.

5. A refractory mold comprising a fired body of investment material contained within a flask and consisting, before firing, essentially of a gypsum binder and a refractory which is at least 15% by weight pyrophyllite.

6. A refractory mold comprising a fired body of investment material contained within a flask and consisting, before firing, essentially of a gypsum binder and a refractory which is from 55 to 65% pyrophyllite.

7. A refractory mold comprising a fired body of investment material contained within a flask and consisting, before firing, essentially of from 20 to 40% weight gypsum and from 60 to 80% by weight refractory consisting of pyrophyllite present in an amount of at least 15% by weight of the refractory.

8. A refractory mold comprising a fired body of investment material contained within a flask and consisting, before firing, essentially of from 20 to 40% by weight gypsum and from 60 to 80% by weight refractory which is from 55 to 65% phyrophyllite.

* * * * *

UNITED STATES PATENT AND TRADEMARK OFFICE

CERTIFICATE OF CORRECTION

PATENT NO. : 4,106,945

DATED : August 15, 1978

INVENTOR(S) : Edmund E. Erndt

It is certified that error appears in the above-identified patent and that said Letters Patent are hereby corrected as shown below:

Precision Metalsmiths, Inc. should be deleted as the Assignee and - - Pre-Vest, Inc., Cleveland, Ohio - - should be substituted therefor.

Col. 2, line 65, after "0.7%" insert - - and 0.1% - -

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*